US006532722B2

(12) United States Patent
Gerhart et al.

(10) Patent No.: US 6,532,722 B2
(45) Date of Patent: Mar. 18, 2003

(54) STRAPPING MACHINE WELD HEAD WITH VIBRATING ANVIL

(75) Inventors: David B. Gerhart, Chicago, IL (US); Wayne J. Thas, Arlington Heights, IL (US); Timothy B. Pearson, Antioch, IL (US)

(73) Assignee: Illinois Tool Works, Glenview, IL (US)

( * ) Notice: Subject to any disclaimer, the term of this patent is extended or adjusted under 35 U.S.C. 154(b) by 0 days.

(21) Appl. No.: 09/908,371

(22) Filed: Jul. 18, 2001

(65) Prior Publication Data

US 2003/0014950 A1 Jan. 23, 2003

(51) Int. Cl.[7] ..... B65B 13/04
(52) U.S. Cl. ..... 53/589; 53/375.9
(58) Field of Search ..... 53/589, 375.9, 53/DIG. 2; 100/33 PB

(56) References Cited

U.S. PATENT DOCUMENTS 4,079,667 A * 3/1978 Lems et al. ..... 100/2
4,378,262 A * 3/1983 Annis, Jr. ..... 100/2
4,479,834 A * 10/1984 Kobiella ..... 100/33 PB
4,776,905 A * 10/1988 Cheung et al. ..... 100/33 PB

* cited by examiner

*Primary Examiner*—Ted Kavanaugh
(74) *Attorney, Agent, or Firm*—Welsh & Katz, Ltd.; Mark W. Croll; Donald J. Breh

(57) ABSTRACT

A strapping head for a strapping machine of the type having a feed assembly and a chute that is configured to position, tension and seal strapping material around a load, includes a body and an anvil mounted to and movable relative to the body. A sealing member is disposed in the anvil for oscillating movement. A drive is operably connected to the sealing member and movable relative to the body to provide oscillating movement to the sealing member. First and second courses of strapping material overlie one another adjacent the sealing member, and oscillation of the sealing member effects a seal of the first and second courses of strapping material to one another.

16 Claims, 3 Drawing Sheets

STRAPPING MACHINE WELD HEAD WITH VIBRATING ANVIL

BACKGROUND OF THE INVENTION

Strapping machines are well known in the art. Typically these machines are used for securing straps around loads. One type of strapper is used with a plastic or polymeric strap and is a stationary arrangement in which the strapper is included as part of an overall manufacturing or packaging system.

A typical strapper includes a frame to which various components are mounted. A chute is mounted to the frame through which the strapping material is fed around a load. A strapping head and a drive or feed mechanism are mounted to the frame. The strapping material is fed from a source, by the feed assembly, through the strapping head. The strapping material traverses around the chute and back to the strapping head. Various guides may be mounted to the frame to provide a path for the strap. For example, a guide may be positioned at the feed assembly to guide the strap into feed wheels. A guide may also be positioned between the feed assembly and the strapping head to provide a strap path from the feed assembly to the head.

The strapping or welding head provides a number of functions. First, the strapping head includes a gripper having one or more gripper portions that grip the strap during the course of a strapping operation. The strapping head also includes a cutter to cut the strap from a strap source or supply. Last, the strapping head includes a sealer to seal an overlying course of strapping material onto itself. This seal is commonly referred to as a weld and is effected by heating one course of the strap by use of a vibrating element.

Known strapping heads include a body and an anvil between which the courses of strap materials traverse during a strapping operation and between which the strapping material courses are held during the welding operation. The gripper is mounted within the body and is operably connected to a camshaft having a plurality of cams thereon. Cam lobes move the gripper into and out of engagement with the strapping material to effect the necessary gripping functions during the strapping operation. The anvil is maintained rigidly against the body and a vibrating element within the body oscillates or vibrates thus creating friction and heat to effect the weld.

The vibrating element is disposed within the strapping head body. During the course of welding the strapping material onto itself, the gripper must maintain a sufficient pressure on the strap, against the anvil, to assure that the strap does not slip as the vibrating element vibrates (i.e., as the seal is made). To this end, complex linkages are required to assure that the gripper (mounted within the body) maintains contact with the strap (and the anvil) when the vibrating element is actuated. As such, strapping heads can be of complex, construction and design, particularly when large tensions are required in the strap to maintain the load bundled.

Accordingly, there exists a need for a simplified welding or strapping head for use in a strapping machine. Desirably, such a welding head eliminates the need for complex linkages otherwise required to maintain the gripping portion in contact with the strap (and the anvil) when the vibrating element is actuated. More desirably, such a strapping head is of a compact design. Most desirably, in such a strapping head, the vibrating element is removed from the strapping head body.

BRIEF SUMMARY OF THE INVENTION

A strapping head is used in a strapping machine of the type having a feed assembly and a chute. The strapping machine is configured to position, tension and seal strapping material around a load. The strapping head is positioned adjacent the chute.

The strapping head includes a body and an anvil mounted to and movable relative to the body. In a present embodiment, strapping head includes a side plate pivotally mounted to the body and the anvil is fixedly mounted to the side plate.

The strapping head further includes a gripper assembly disposed in the body and a sealing member disposed in the anvil for oscillating movement. A drive is operably connected to the sealing member to provide oscillating movement to the sealing member.

First and second courses of strapping material overlie one another in the strapping head, adjacent the sealing member. Oscillation of the sealing member effects a seal of the first and second courses of strapping material to one another.

In a preferred configuration, the sealing member drive is mounted to the side plate for movement with the anvil. To effect oscillation, the drive includes an eccentric drive element and the sealing member include a coupling portion for coupling with the eccentric drive element. The eccentric drive element can be configured as an eccentric shaft and the coupling portion can include a non-circular receiving opening for receiving the shaft. In such a configuration, a bearing is disposed on the shaft for contact with the receiving opening.

To accommodate the sealing member, the anvil includes a channel formed therein. Bearings can be disposed within the channel for receiving the sealing member.

The strapping head can include a platen for maintaining the first and second courses of strapping material compressed against the sealing element. The platen can be disposed between first and second grips within the gripper assembly, with the cutter disposed adjacent the platen.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
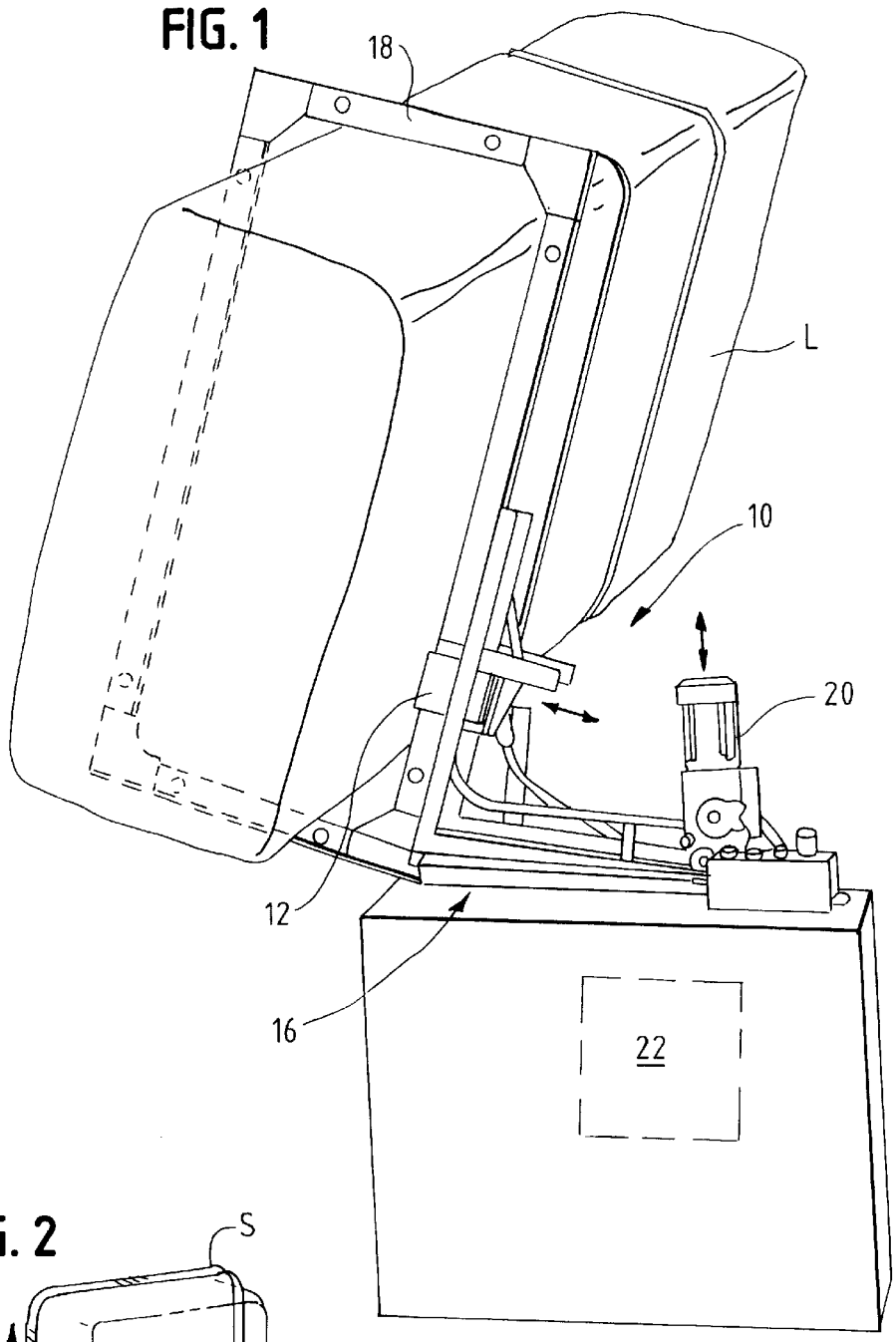
FIG. 1 is a perspective view of an exemplary strapping machine having a strapping head with a vibrating member anvil embodying the principles of the present invention.
Figure 2:
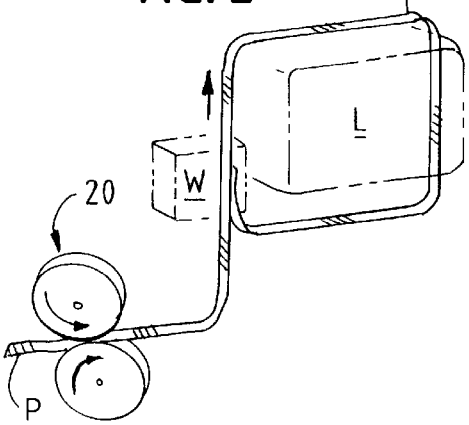
FIG. 2 is a schematic view of the exemplary strapping machine showing a load positioned in the chute region, and the strap source feeding the machine via a feed assembly.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring to the figures and in particular FIG. 1, there is shown a strapping machine 10, having a strapping or weld head 12 with a vibrating member anvil 14, embodying the principles of the present invention. The machine 10 includes, generally, a frame 16, a strap chute 18 and a feed assembly 20. A controller 22 provides automatic or semi-automatic operation and control of the strapper 10. The weld head 12 includes generally, a body 24 and an anvil 26. A gripper assembly 28 and a cutter 30 are carried by the body 24. Preferably the cutter 30 is disposed within the gripper assembly 28.

Figure 3:
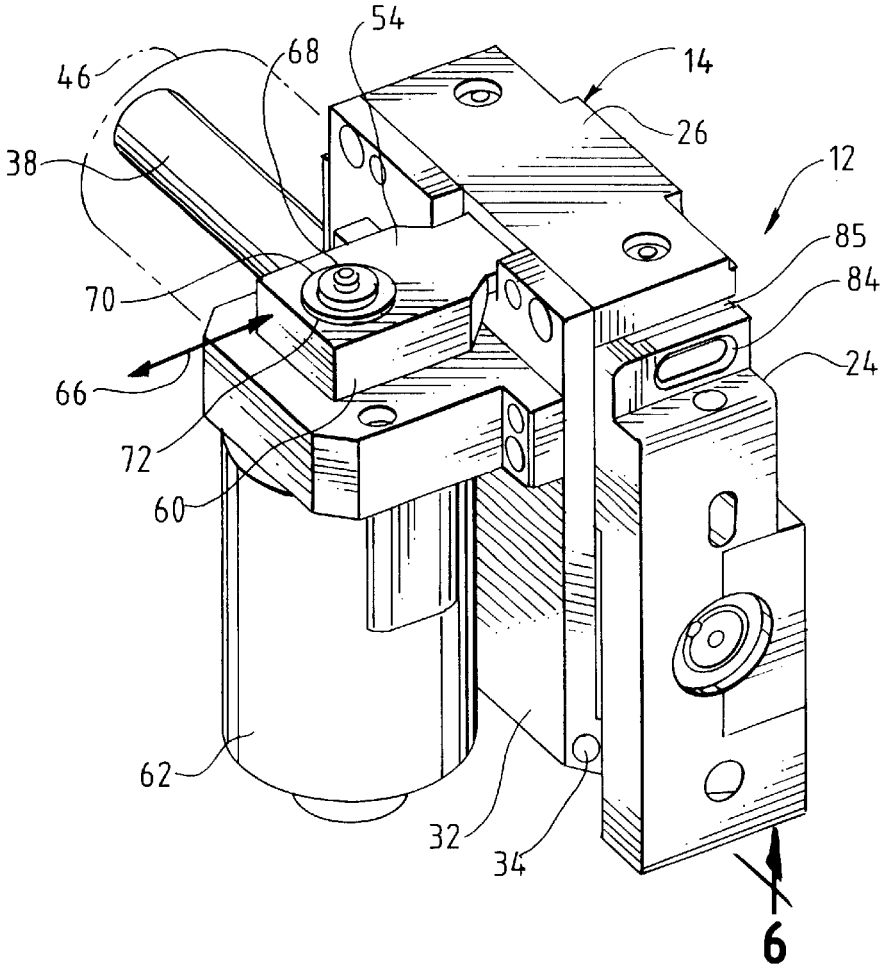
FIG. 3 is a side perspective illustration of the strapping head, illustrating the weld motor mounted to the strapping head side plate.

Referring to FIG. 3, the anvil 26 is movably mounted to the strapping head body 24. In a preferred arrangement, the anvil 26 is fixedly mounted to a side plate 32 that moves relative to the body 24. Preferably, the side plate 32 (and thus the anvil 26) pivots about and relative to the body 24. The anvil 26 moves between a closed position, in which the strap S is grasped, cut and welded, and an open position in which the strap S is allowed to freely pull from the head 12 following a strapping operation. The side plate 32 (and thus the anvil 26) can be pivotally mounted to the strapping head body 24 by a pivot pin 34.

Figure 6:
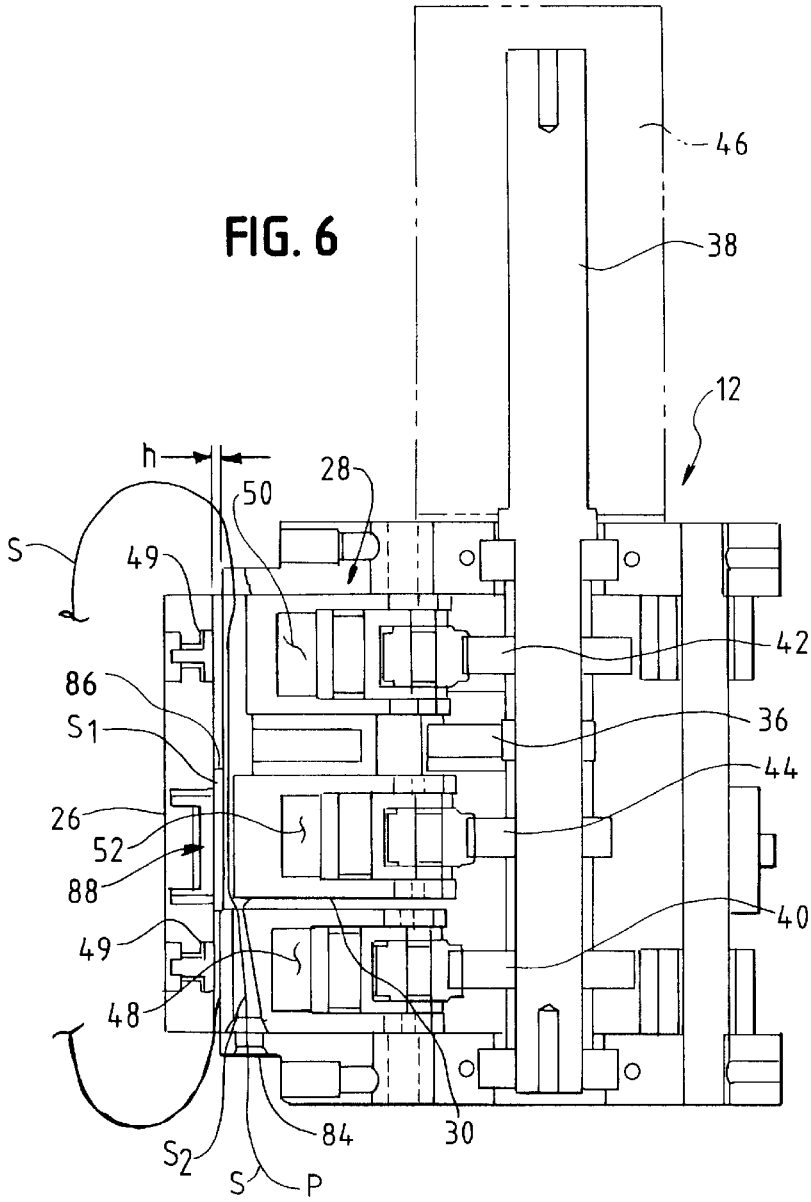
FIG. 6 is a cross-sectional view of the strapping head taken along lines 6—6 of FIG. 3.

Referring to FIG. 6, pivotal movement of the plate 32 and anvil 26 can be provided by, for example, a cam 36 mounted on a camshaft 38 disposed within the strapping head body 24. The shaft 38 can be have other cams 40, 42, 44 (described below) thereon for moving portions of the gripper assembly 28 and cutter 30 into and out of engagement with the strap S. The plate cam 36 engages the side plate 32, thus pivoting the side plate 32 and anvil 26 outwardly, away from the body 24, into the open position. The side plate 32 is biased, by a biasing member such as a spring (not shown), to the closed position. A motor 46 drives the camshaft 38.

The gripper assembly 28 includes at least two gripping portions (referred to as grips). In a current embodiment, the gripper assembly 28 includes an end grip 48 and a loop grip 50. Preferably, a platen 52 or like element is disposed adjacent or within the gripper 28 that is brought into contact with the strap S during the welding operation, as will be described in more detail below. In a current embodiment, the platen 52 is positioned between the end grip 48 and the loop grip 50, adjacent the cutter 30.

Figure 4:
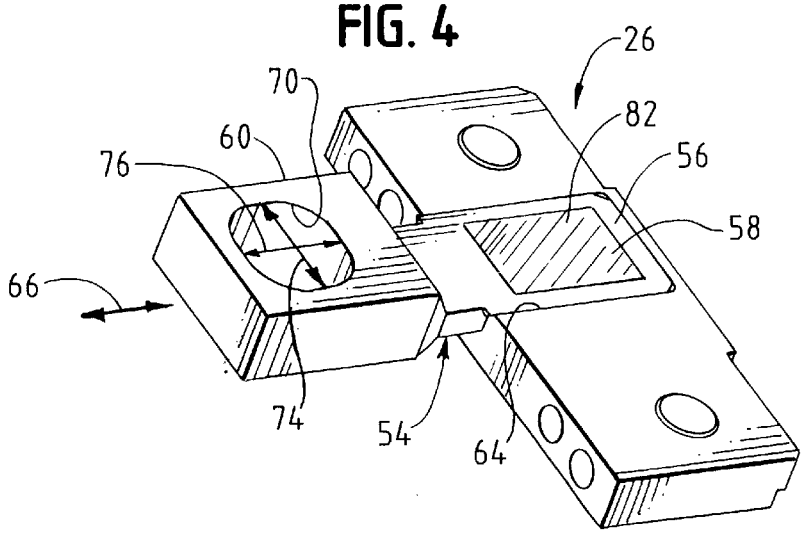
FIG. 4 is a bottom perspective illustration of the anvil and vibrating member.
Figure 5:
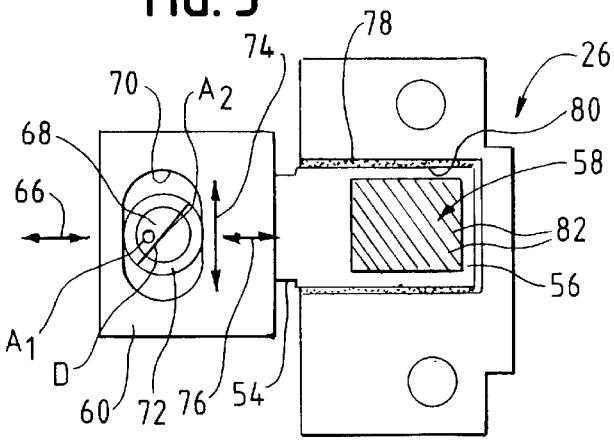
FIG. 5 is a bottom view of the anvil and vibrating member of FIG. 4.

Referring now to FIGS. 3–5, unlike known strapping heads, the present strapping head 12 utilizes a sealing member, such as the illustrated vibrating member 54 that is disposed in the anvil 26. That is, while known strapping heads have the vibrating or welding element disposed within the head body, the present head 12 positions the vibrating member 54 within moving anvil 26. The vibrating member 54 includes a welding end 56 having a weld pad or weld region 58 and a coupling end 60.

A motor 62 is operably connected to the vibrating member 54 to effect, the necessary vibrations or oscillations of the member 54. In a current combodiment, the motor 62 is mounted to the side plate 32, and thus moves or pivots with the anvil 26. In this manner, the motor 62 is fixedly mounted relative to the anvil 26 and vibrating member 54.

The vibrating member 54 is disposed within an open channel 64 in the anvil 26. The weld pad portion 58 of the member 54 contacts the strap S during the welding operation. The vibrating member 54 oscillates, in a generally reciprocating manner, in the direction indicated by the double headed arrow at 66 within the channel 64.

As best seen in FIG. 5, to effect oscillation of the vibrating member 54, the motor 62 includes an eccentric drive element, such as the exemplary eccentric drive shaft 68 extending through a receiving opening 70 in the vibrating member coupling end 60. A bearing 72 is mounted to the shaft 68. The eccentric shaft 68 is configured such that the axis of rotation $A_1$ is off-center of the shaft axis $A_2$.

The receiving opening 70 is a non-circular opening. The opening 70 is elongated in a direction (indicated at 74) transverse to the reciprocating movement direction 66 of the member 54. The dimension of the opening 70 in the reciprocating movement direction (as indicated at 76) is about the same as the diameter D of the eccentric shaft 68. In this manner, the shaft 68 (having the bearing 72 fitted thereto) makes a tight fit in the opening 70 in the direction of movement 66, but has dimensional freedom in the direction transverse to the reciprocating direction 66. To this end, as the shaft 68 rotates eccentrically, it imparts reciprocating (i.e., linear) motion to the vibrating member 54, but does not impart any side-to-side motion to the member 54.

Those skilled in the art will appreciate that other means to drive the vibrating member 54 can be employed. For example, linkages, cogs, gears and the like can be used to impart vibrating motion to the member 54. Likewise, other electromechanical, mechanical or electrical arrangements can be used. All such other means are within the scope and spirit of the present invention.

Referring now to FIG. 5, bearings 78 are disposed between the vibrating member 54 and the walls 80 defining the channel 64. In a current embodiment, needle type bearings 78 are used to permit free reciprocating motion or oscillation 66 of the vibrating member 54 and to reduce friction between the vibrating member 54 and the channel walls 80. The bearings 78 also ensure that movement of the member 54 within the channel 64 is restricted to reciprocating movement, rather than side-to-side movement.

As set forth above, the vibrating member 54 includes a weld pad or weld region 58. This is the region that contacts the strap S during vibration to thus effect the weld or seal. In a current embodiment, the weld pad 58 is formed by cuts, (e.g., serrations) as indicated at 82 in the weld pad 58. Those skilled in the art will recognize that there are various configurations and structures that can be used to effect the weld region 58.

Operation of the sealing head 12 will now be described with reference to FIG. 6. Strapping material S is fed into the strapping head 12 through opening 84, traverses through the strapping head 12, through the chute 18 and around the load L, and returns to the strapping head 12, entering through second opening 85. The first course of strapping material $S_1$ stops at a predetermined location in the strapping head 12, as indicated at 86. This stop 86 is provided by restricting the height h of the path through the head 12 at this point to about 1–½ times the thickness of the strap S.

Once the first course of strapping material $S_1$ reaches the stop 86, a sensor (not shown) signals the controller 22 to stop strap feed. The end grip 48 is then moved toward the anvil 26 by contact of the cam 40 with the grip 48. Once the end grip 48 is in place, the strap S is secured between the grip 48 and a gripper pad 49 on the anvil 26. In a preferred configuration, the gripper pad 49 is replaceable. The strap S is tensioned by, for example, retraction of the strap S.

When a desired tension in the strap S is reached, the loop grip 50 moves into engagement with the strap S and anvil 26, again by engagement of the cam 42 with the grip 50. At this point in time, both the end grip 48 and loop grip 50 are fully engaged with the strap S secured between the respective grips 48, 50 and gripper pads 49 in the anvil 26.

The cutter 30 and platen 52 then move toward the anvil 26 by engagement of the cam 44 with the platen 52. The cutter 30 cuts one course strap S to separate the strap S from the strap supply P. At the same time, the platen 52 presses the strap S against the anvil 26.

The weld motor 62 is then actuated to oscillate the weld member to effect a weld in the strap material S at the area generally indicated at 88. After a predetermined period of time during which acceptable weld strength is reached, and after cooling, the end grip 48 and loop grip 50 as well as the platen 52 and cutter 30 are moved away from the anvil 26 (by further rotation of the camshaft 38) and the side plate 32 anvil 26 pivot outwardly, away from the body 24. This releases the strap S from the head 12.

The load L is then removed from the chute 18 region, and a new load is set in place for strapping. The side plate 32 and anvil 26 are then moved back into the closed position and strapping material S is again fed through the strapping head 12, into the chute 18 around the load L and back to the strapping head, to repeat the strapping procedure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A strapping head for a strapping machine of the type having a feed assembly and a chute, the strapping machine configured to receive first and second courses of associated strapping material, position, tension and seal the strapping material around a load, the strapping head configured for positioning adjacent the chute, the strapping head comprising:

a stationary body;

an anvil mounted to and movable relative to the body;

a gripper assembly disposed in the body;

a sealing member disposed in the anvil for oscillating movement;

a side plate pivotally mounted to the stationary body; and a drive fixedly mounted to the side plate and operably connected to the sealing member to provide oscillating movement to the sealing member, wherein the anvil is mounted to the side plate, and wherein the first and second courses of strapping material are positioned to overlie one another adjacent the sealing member, and wherein oscillation of the sealing member effects a seal of the first and second courses of strapping material to one another.

2. The strapping head in accordance with claim 1 wherein the drive includes an eccentric drive element and the sealing member includes a coupling portion for coupling with the eccentric drive element.

3. The strapping head in accordance with claim 2 wherein the eccentric drive element is an eccentric shaft and the coupling portion includes a non-circular receiving opening for receiving the shaft.

4. The strapping head in accordance with claim 3 wherein the shaft includes a bearing disposed thereon for contact with the receiving opening.

5. The strapping head in accordance with claim 1 wherein the anvil includes a channel therein for receiving the sealing member.

6. The strapping head in accordance with claim 5 including bearings disposed within the channel for receiving the sealing member.

7. The strapping head in accordance with claim 1 including a platen for maintaining the first and second courses of strapping material compressed against the sealing element.

8. The strapping head in accordance with claim 7 wherein the platen is disposed between first and second grips within the gripper assembly.

9. The strapping head in accordance with claim 8 including a cutter disposed adjacent the platen.

10. A strapping head for a strapping machine of the type having a feed assembly and a chute, the strapping machine configured to receive first and second courses of associated strapping material, position, tension and seal the strapping material around a load, the strapping head configured for positioning adjacent the chute, the strapping head comprising:

a stationary body;

a side plate movably mounted to the stationary body;

an anvil fixedly mounted to the side plate and movable relative to the body with the side plate;

a gripper assembly disposed in the body;

a sealing member disposed for vibrating movement in the anvil; and a drive fixedly and directly mounted to the side plate, the drive being movable with the side plate and fixed relative to the anvil, the drive being operably connected to the sealing member, wherein first and second courses of strapping material are positioned to overlie one another adjacent the sealing member, and wherein vibration of the sealing member effects a seal of the first and second courses of strapping material to one another.

11. The strapping head in accordance with claim 10 wherein the drive includes an eccentric drive shaft and the sealing member includes a coupling portion having a slotted opening for receiving the eccentric drive shaft.

12. The strapping head in accordance with claim 11 including a bearing disposed on the eccentric drive shaft for contact with the receiving opening.

13. The strapping head in accordance with claim 10 wherein the anvil includes a channel therein for receiving the sealing member, and including bearings disposed within the channel for contacting the sealing member.

14. The strapping head in accordance with claim 10 including a platen for maintaining the first and second courses of strapping material compressed against the sealing element.

15. The strapping head in accordance with claim 14 wherein the platen is disposed between first and second grips within the gripper assembly.

16. The strapping head in accordance with claim 15 including a cutter disposed adjacent the platen.

* * * * *